US009422741B1

(12) United States Patent
Conte

(10) Patent No.: US 9,422,741 B1
(45) Date of Patent: Aug. 23, 2016

(54) BALL FIELD SUSPENDED FENCE POST BASE SUPPORT AND POST SUPPORT WITH LATERAL SUPPORT

(71) Applicant: Matthew A. Conte, Bridgeport, CT (US)

(72) Inventor: Matthew A. Conte, Bridgeport, CT (US)

( * ) Notice: Subject to any disclaimer, the term of this patent is extended or adjusted under 35 U.S.C. 154(b) by 0 days.

(21) Appl. No.: 14/697,567

(22) Filed: Apr. 27, 2015

Related U.S. Application Data

(60) Provisional application No. 61/990,799, filed on May 9, 2014.

(51) Int. Cl.

| | |
|---|---|
| ***E04H 17/22*** | (2006.01) |
| ***E04H 12/22*** | (2006.01) |
| ***E04H 17/08*** | (2006.01) |
| ***E04H 17/20*** | (2006.01) |

(52) U.S. Cl.
CPC ..... *E04H 17/22* (2013.01); *E04H 12/223* (2013.01); *E04H 12/2223* (2013.01); *E04H 12/2269* (2013.01); *E04H 17/08* (2013.01); *E04H 17/20* (2013.01)

(58) Field of Classification Search
CPC ..... E04H 17/08; E04H 17/20; E04H 17/22; E04H 12/2269; E04H 12/223; E04H 12/2223
USPC ..... 52/146, 156, 158, 159, 165, 166
See application file for complete search history.

(56) References Cited

U.S. PATENT DOCUMENTS

| | | | | |
|---|---|---|---|---|
| 3,845,597 | A * | 11/1974 | Foster | E02D 5/80 52/157 |
| 4,603,520 | A * | 8/1986 | Deike | E04H 17/08 52/157 |
| 5,791,635 | A * | 8/1998 | Hull | E04H 17/22 248/156 |
| 6,343,449 | B1 * | 2/2002 | MacKarvich | E02D 5/801 24/545 |
| 6,722,821 | B1 * | 4/2004 | Perko | E02D 5/801 405/249 |
| 6,928,783 | B2 * | 8/2005 | Oliver | E02D 5/801 52/149 |
| 7,004,683 | B1 * | 2/2006 | Rupiper | E02D 5/56 405/229 |
| 8,573,565 | B1 | 11/2013 | Lyndaker et al. | 256/23 |
| 8,844,209 | B1 * | 9/2014 | Oliver | E02D 27/50 52/157 |
| 2004/0221543 | A1 * | 11/2004 | Eleas | E02D 5/56 52/153 |
| 2007/0120035 | A1 * | 5/2007 | Albanese | E04H 12/2223 248/530 |
| 2013/0111829 | A1 * | 5/2013 | Pedraza | E02D 5/80 52/166 |

* cited by examiner

*Primary Examiner* — Adriana Figueroa
(74) *Attorney, Agent, or Firm* — Fattibene and Fattibene LLC; Paul A. Fattibene

(57) ABSTRACT

A helical pile having lateral support. A helical pile has lateral support plates that extend in a vertical direction parallel to the axis of the helical pile and substantially perpendicular to a plane of a helix on the helical pile. A helical support rod assembly provides additional lateral support to a helical pile. The helical support rod assembly has a longitudinal axis that intersects the longitudinal axis of the helical pile. The helical pile provides a foundation for a post, such as a support post used in supporting a suspended fence in a ball field. The helical support rod assembly provides additional lateral support that may be required for larger post, such as a foul pole in a ball field. The time and labor for installing a foundation for posts is substantially reduced.

10 Claims, 9 Drawing Sheets

BALL FIELD SUSPENDED FENCE POST BASE SUPPORT AND POST SUPPORT WITH LATERAL SUPPORT

RELATED APPLICATION

This application claims the benefit of U.S. Provisional Application No. 61/990,799 filed May 9, 2014.

FIELD OF THE INVENTION

The present invention relates in general to a helical pile adapted to support a post, and particularly to a helical pile providing support for lateral loads and supporting a fence post used for supporting a safety support fence used in baseball.

BACKGROUND OF THE INVENTION

Posts are often required to be supported. Typically a fence support post is simply driven to the ground or a hole is dug and concrete is poured into the hole. Sometimes a cylindrical tube is used as a mold to hold the concrete. This is often a time-consuming and it laborious process. This is particularly problematic when a number of support posts must be erected for example in a seasonal safety support fence used to bound an outfield of a baseball field. One such safety support fence is disclosed in U.S. Pat. No. 8,573,565 entitled "Multipurpose Seasonal Safety Support Fence" issuing to Lyndaker et al. on Nov. 5, 2013, which is herein incorporated by reference. Therein disclosed is a safety support fence comprising a plurality of mesh panels suspended from a plurality of support posts and having foul post at either end.

Additionally, there are applications where posts may need to be installed quickly and without substantial ground preparation. To satisfy this need post bases using a helix or screw have been used too quickly provide a foundation for the installation of a post onto the post base. While the support necessary for relatively small posts are met by the post bases installed with a helix or screw have been adequate, for larger post installations the conventional post base using a helix or screw have provided insufficient lateral support for the post. Accordingly the post base using a helix or screw vertically driven into the ground would often tilt or shift causing the post or pole to lean. This base instability is often exaggerated due to the length of larger post attached to the base and loads on the post, Therefore, even small lateral shifts of the post base will result in substantial leaning of larger post or poles. Additional, lateral support is also needed in some applications, such as offset suspended mesh panels used in fencing for a ball field as disclosed in U.S. Pat. No. 8,573,565. Therefore, there is a need to provide a post base that is easy to install and provides substantial lateral support so as to prevent tilting or shifting of the post or post base.

SUMMARY OF THE INVENTION

The present invention is a helical pile with lateral support. The invention is used to quickly install fence posts and other post requiring lateral support. A plurality of helixes are attached to a pile, with the helixes spaced longitudinally along a pile. Some of the helixes have a lateral support plate extending from the helixes substantially perpendicular thereto and in a direction substantially parallel to the longitudinal axis of the pile. In one embodiment a cylinder having at least one helix therein is positioned adjacent and below the surface providing additional lateral support.

Another embodiment providing additional lateral support has a helical support rod having a longitudinal axis that is transverse to the helical pile and is attached to the helical pile by an angled lateral support plate. The angled lateral support plate is configured or adapted so as to be attached to any side of the vertical pile top plate.

Is an object of the present invention to provide a foundation so that post can be installed quickly, easily, and securely.

It is another object of the present invention to provide enhanced lateral support for a helical pile.

It is an advantage of the present invention that different configurations may be used for adapting to different applications.

It is another advantage of the present invention that both time and labor to install a foundation for a post is substantially reduced.

Is a feature of the present invention that a lateral support plate is attached to a helix providing enhanced lateral support.

It is another feature of the present invention that a lateral support structure is placed between the helical pile and the ground surface.

It is yet another feature of the present invention that a lateral support structure comprises a helical support rod with a longitudinal axis that transverses a helical pile longitudinal axis.

It is still another feature of the present invention that an angled lateral support plate is configured or adapted to attach to any side of a vertical pile top plate.

These and other objects, advantages, and features will become more readily apparent in view the following detailed description.

DETAILED DESCRIPTION OF THE INVENTION

Figure 1:
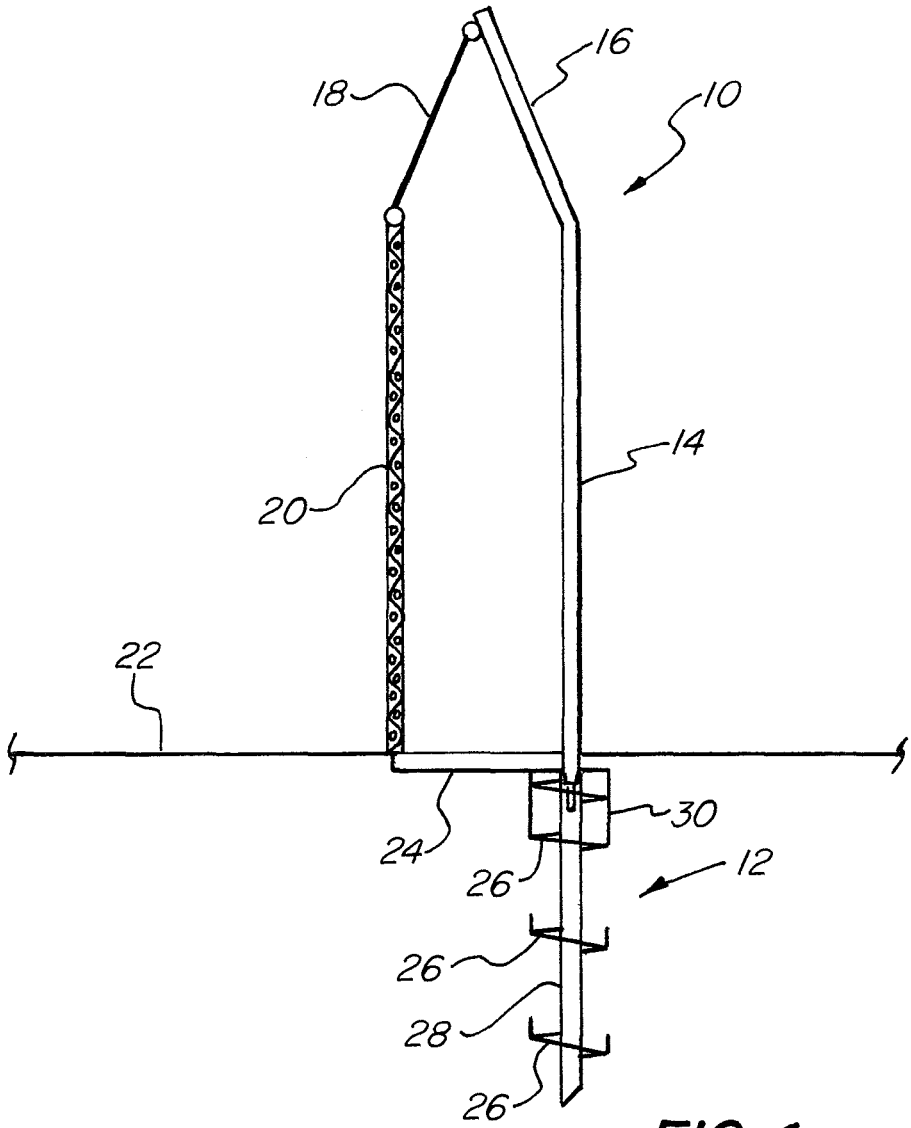
FIG. 1 schematically illustrates the invention.

FIG. 1 schematically illustrates the application of the present invention for its intended purpose of supporting a safety support fence 10 with a helical pile or post support 12. The safety support fence 10 comprises a vertical fence support post 14 and an angled fence support member 16 attached to a cable 18 that is attached to the suspended safety fence 20. The base of the suspended safety fence 20 is coupled to the helical pile or post support 12 by a lateral fence tie 24. The safety support fence 10 bounds the outfield of a ball field 22. The safety support fence 10 provides flexibility so as to prevent injury to players should they contact the safety support fence 10.

The helical pile or post support 12 comprises a solid or hollow pipe or pile having a plurality of helical plates 26 attached thereto along the longitudinal length of the pipe or pile 28. The end of the pipe 28 entering the ground may be angled permitting easier penetration. Placed adjacent the opposing end of the pipe 28 near the surface is a lateral support or subsurface cylinder 30. The subsurface cylinder 30 may also have helical plates 26 contained therein. The subsurface cylinder 30 provides lateral support adjacent the end of the pipe 28 receiving the vertical fence support post 14.

The helical pile or postal support 12 may be screwed into the ground using a planetary driver or auger unit. The helical pile or post support 12 of the invention replaces the use of a poured concrete cylindrical form or a fiber tube used to set the fence post in concrete. Such tubes are sold under the trademark SONOTUBE. Some of the helical piles or post supports 12 may have vertical plates attached to the helical plates 26 to provide additional lateral support. Also different diameters or larger pipes or piles 28 may be used depending on soil conditions. The helical plates 26 and vertical plates may be attached throughout the entire length of the pipe or pile 28 as required to support the loading of the safety support fence 10. The invention provides a shallow helical pile or post that may be installed in soil to support vertical and lateral loads placed on the safety support fence 10. The invention may also be used to support foul poles placed at the ends of the safety support fence 10 when used in a ball field. The helical pile or post support 12 may be used to replace poured concrete structures and shallow post set in concrete in other applications where applicable to support the required loads.

FIGS. 2-6 illustrate additional embodiments of the helical pile or post support 12 of the present invention, as illustrated in FIG. 1.

Figure 2A:
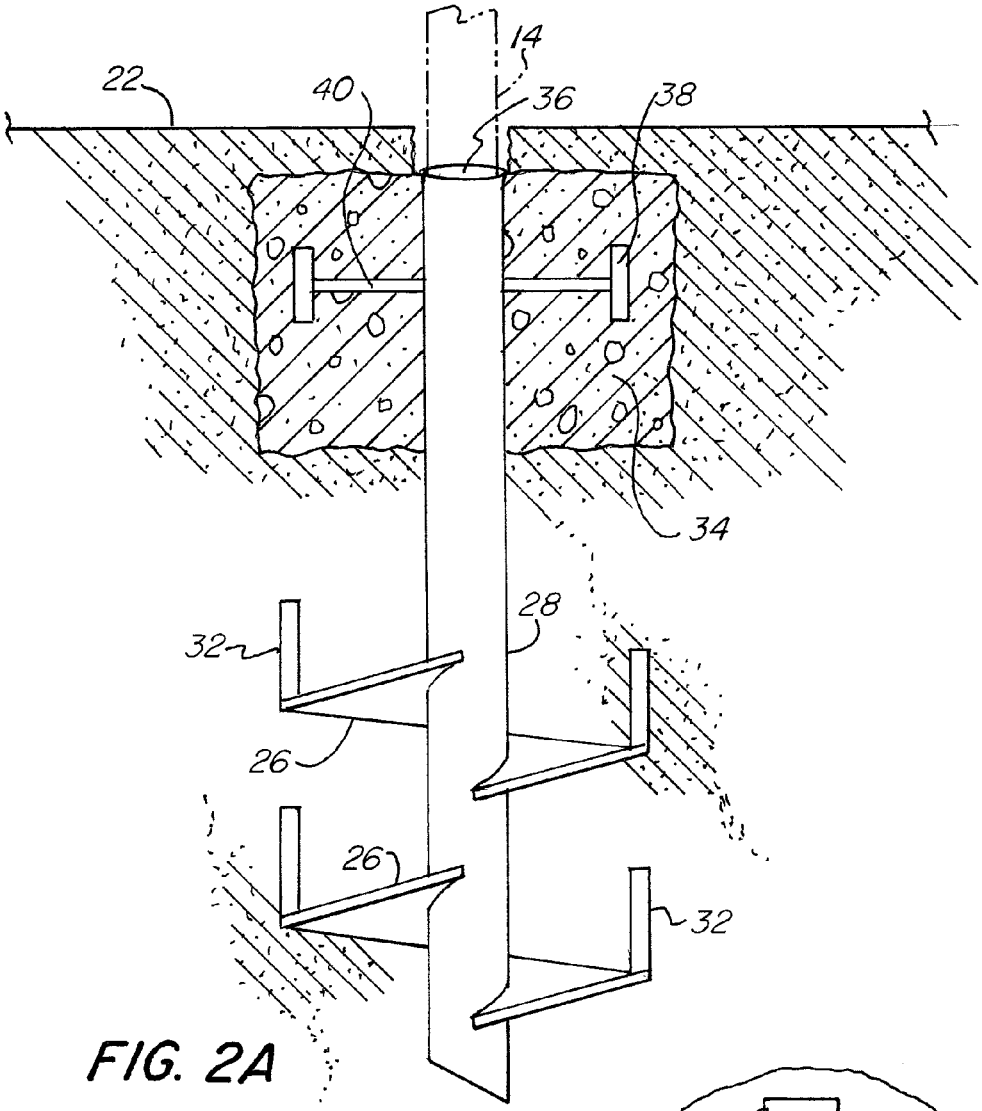
FIG. 2A is an elevational view schematically illustrating an embodiment of the invention.
Figure 2B:
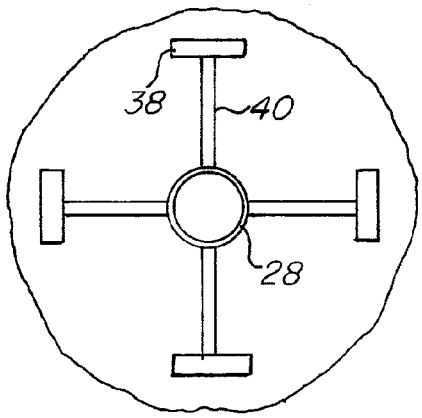
FIG. 2B is a plan view schematically illustrating the embodiment of the invention illustrated in FIG. 2A.

FIGS. 2A-B illustrates an embodiment having concrete 34 with embedded lateral rods 40 having a vertical end 38 to provide additional lateral support adjacent the pipe or pile opening 36 for providing increased lateral stability for the vertical fence support post 14. Additionally, helical plates 26 have lateral support plates 32 perpendicularly attached thereto. The lateral support plates 32 may be placed at different locations over the perimeter of the helical plates 26. The lateral support plates 32 extend substantially perpendicular from the plane of the helical plates 26 and substantially parallel to the longitudinal axis of the pipe or pile 28 providing lateral support. The diameter of the helical plates 26 may be selected based on soil conditions and the anticipated loading.

Figure 3:
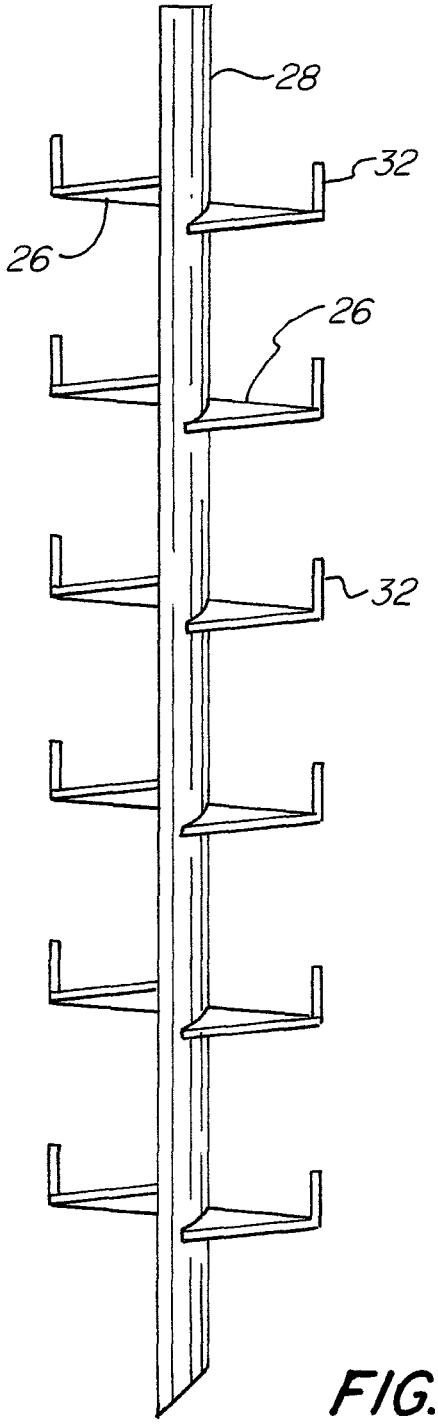
FIG. 3 schematically illustrates another embodiment of the invention.

FIG. 3 illustrates another embodiment of the invention wherein the helical plates 26 extend along the full longitudinal length of the pipe or pile 28. The helical plates 26 are preferably substantially evenly spaced along the longitudinal length.

Figure 4:
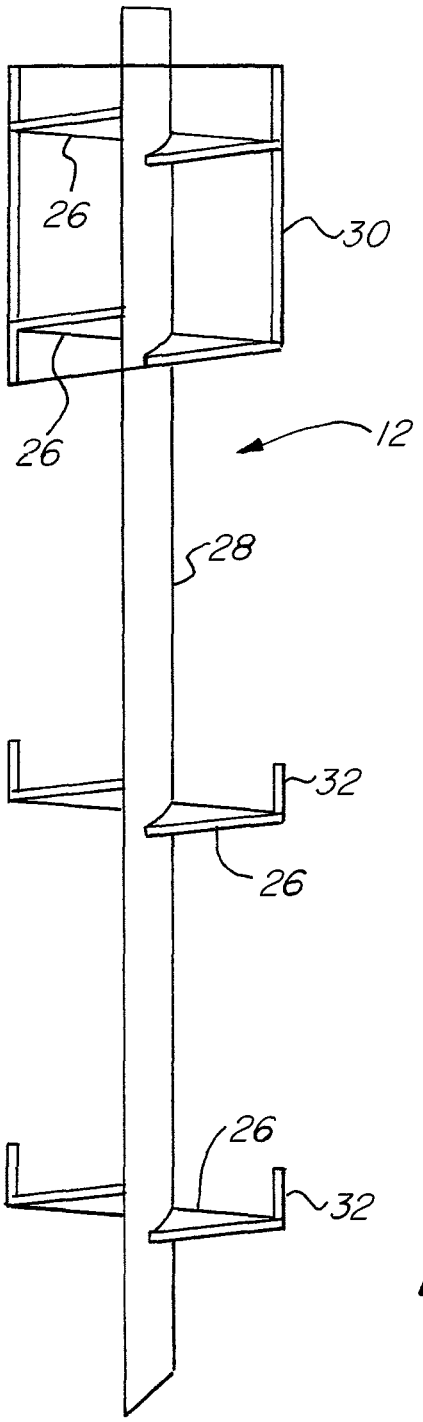
FIG. 4 schematically illustrates another embodiment of the invention.

FIG. 4 is an enlarged view of the helical pile or post support 12 illustrated in FIG. 1. This embodiment uses subsurface cylinder 30 containing helical plates 26 to provide additional lateral support adjacent an end of the pile or post 28 adjacent to where the post 14, illustrated in FIG. 1, would attach.

Figure 5:
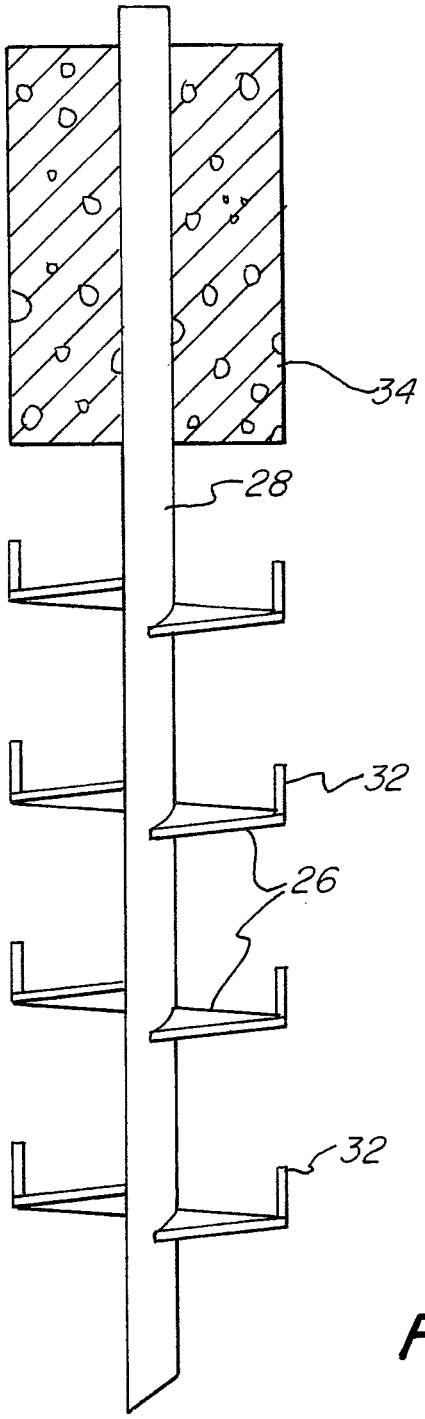
FIG. 5 schematically illustrates another embodiment of the invention.

FIG. 5 illustrates another embodiment having concrete 34 providing additional support adjacent one end of the piper pile 28.

Figure 6:
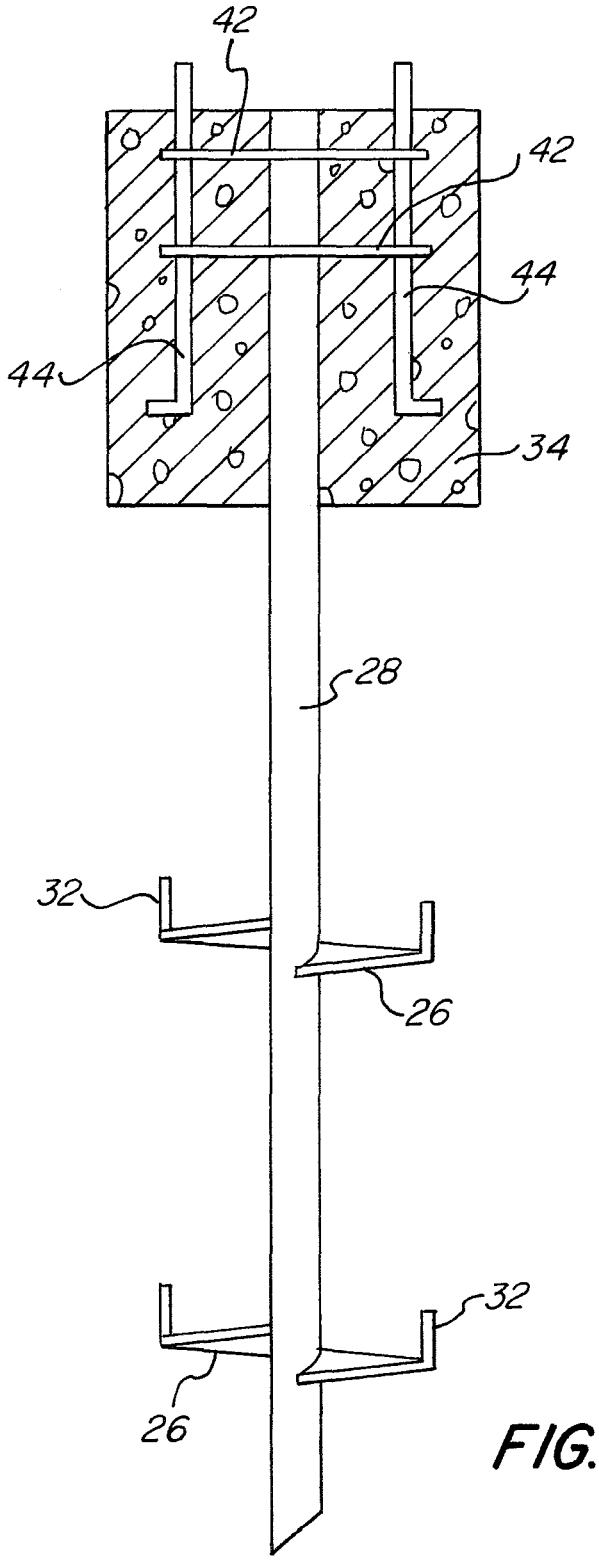
FIG. 6 schematically illustrates another embodiment of the invention.

FIG. 6 illustrates another embodiment of the invention having concrete 34 with circular plates 42 and anchor bolts 44 placed therein. The anchor bolts 44 are placed in holes within the circular plates 42 and extend upward above the surface of the concrete 34. A pole, such as a foul pole used in a baseball field may be bolted to the anchor bolts 44.

FIGS. 7-12 illustrate a preferred embodiment of the present invention. The embodiment illustrated in FIGS. 7-12 has a lateral support structure for supporting large posts or when additional lateral support is desired. One particular useful application is for a foundation for supporting a foul pole used in a baseball field.

Figure 7:
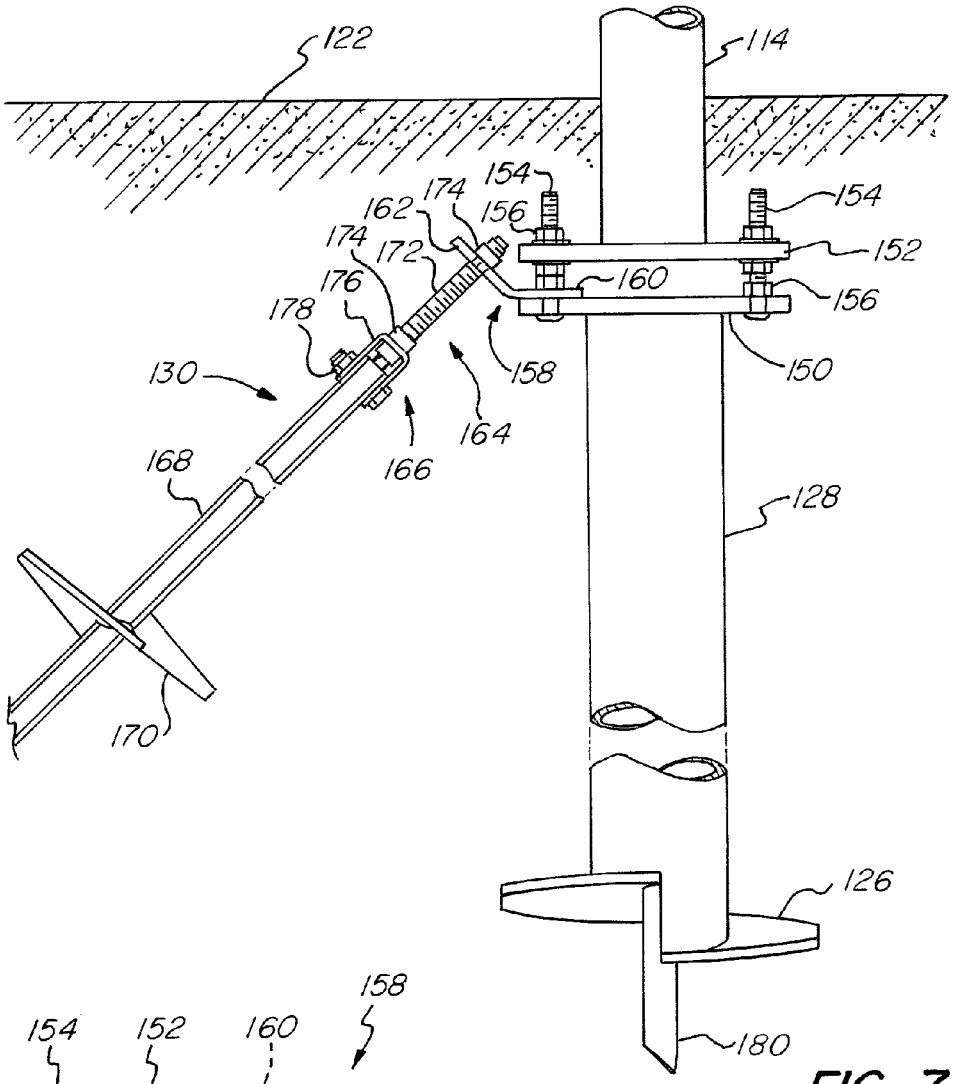
FIG. 7 is an elevational view schematically illustrating another embodiment of the invention having underground lateral support.

FIG. 7 is an elevational view schematically illustrating this embodiment. A vertical post 114, which may be a foul pole for a baseball field, is attached to a helical pile 128 the helical pile has a helix plate or helix 126. The helix plate or helix 126 extends radially from the longitudinal axis of the helical pile 128. A pilot point 180 is placed on one end of the helix pile 128 adjacent the helix 126. Attached to the other end of the helix pile 128 is a vertical pile top plate 150. The vertical pile top plate 150 is bolted to a vertical post bottom plate 152. The vertical post bottom plate 152 is attached to the vertical post 114. The vertical post bottom plate 152 and the vertical pile top plate 150 are attached together by bolts 154 and nuts 156. Attached on one side of the vertical pile top plate 150 is an angled lateral support plate 158. The angled lateral support plate 158 has a pile leg 160 and a lateral support leg 162. The lateral support leg 162 is attached to the lateral support or helical support rod assembly 130. The helical support rod assembly 130 comprises a turnbuckle 164, a shackle 166, a lateral support rod 168, and a helical plate or helix 170. The turnbuckle 164 comprises a bolt 172 and nuts 174. The shackle 166 comprises a U-shaped connector 176 attached to the lateral support rod 168 by a shank 178 having a bolt and nut or other equivalent fastener.

Figure 8:
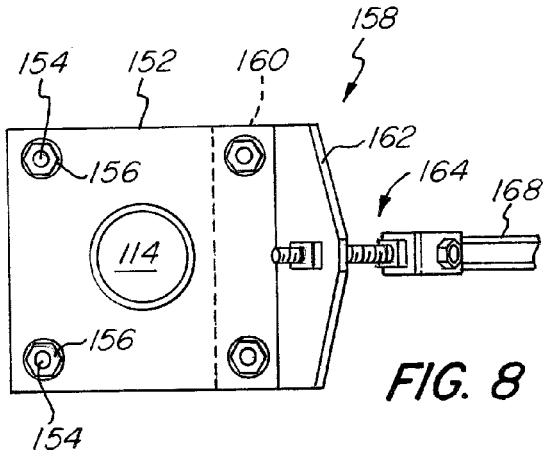
FIG. 8 is a plan view illustrating an angled lateral support plate connected to a vertical post and the lateral support.

FIG. 8 is a plan view illustrating the vertical post bottom plate 152 attached to the angled lateral support plate 158 and the vertical pile top plate 150. The vertical pile top plate 150 is under the vertical post bottom plate 152, and therefore is not seen in FIG. 8. The bolts 154 and nuts 156 couple the vertical post bottom plate 152 to the vertical pile top plate 150. This couples the helical pile 128 securely to the vertical post 114, as illustrated in FIG. 7. The vertical post bottom plate 152 and the vertical pile top plate 150 have a polygon shape that is square. The angled lateral support plate 158 can therefore be attached to any one of the four sides of the vertical pile top plate 150 or the vertical post bottom plate 152.

Figure 9:
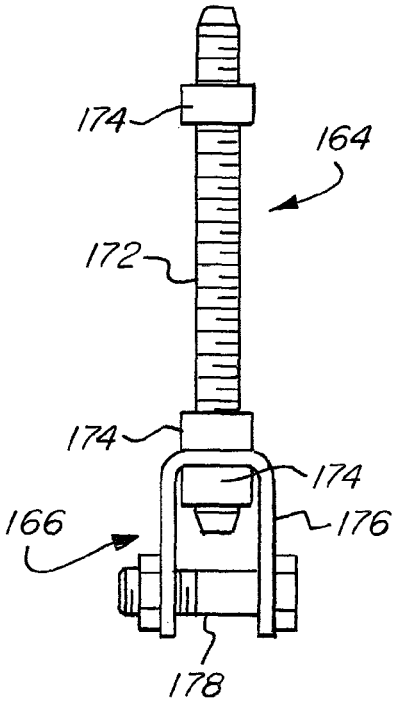
FIG. 9 is an elevational view illustrating the turnbuckle connection between the angled lateral support plate and the lateral support.

FIG. 9 is an elevation a view illustrating the turnbuckle 164 in more detail. As illustrated in FIG. 7 the bolt 172 attaches to the angled lateral support plate 158 and the shank 178 attaches to one end of the lateral support rod 168. The shackle 166 provides some lateral flexibility or movement so as to permit easily couple or alinement to the angled lateral support plate 158. The bolt 172 and nut 174 provide longitudinal positioning between the angled lateral support plate 158 and the lateral support rod 168, illustrated in FIG. 7. This longitudinal and a lateral play or movement greatly facilitates alignment and coupling to the angled lateral support plate 158.

Figure 10:
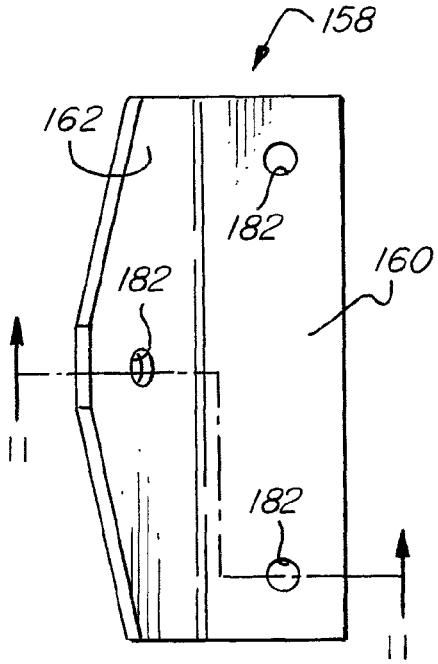
FIG. 10 is a plan view of the angled lateral support plate.

FIG. 10 is a plan view of the angled lateral support plate 158. The lateral support plate 158 has two through holes 182 on the pile leg 160 and a single through hole on the lateral support leg 162. The lateral through holes 182 formed on the pile leg 160 are spaced to coincide with the through holes formed on the vertical pile top plate 150. The through holes on the vertical pile top plate 150 may be elongated or shaped so as to permit easier alignment and insertion of a bolt.

Figure 11:
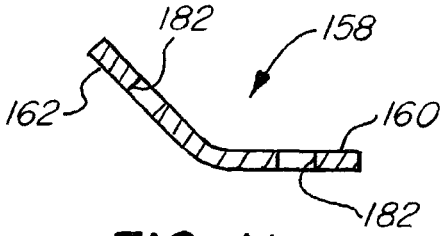
FIG. 11 is a cross section of the angled lateral support plate taken along line 11-11.

FIG. 11 is a cross section taken along line 11-11 in FIG. 10. FIG. 11 more clearly illustrates the angle between the pile leg 160 and the lateral support leg 162 of the angled lateral support plate 158. The angle may range from between one-hundred and twenty degrees to one-hundred and forty five degrees, but is preferably one hundred and thirty-five degrees.

Figure 12:
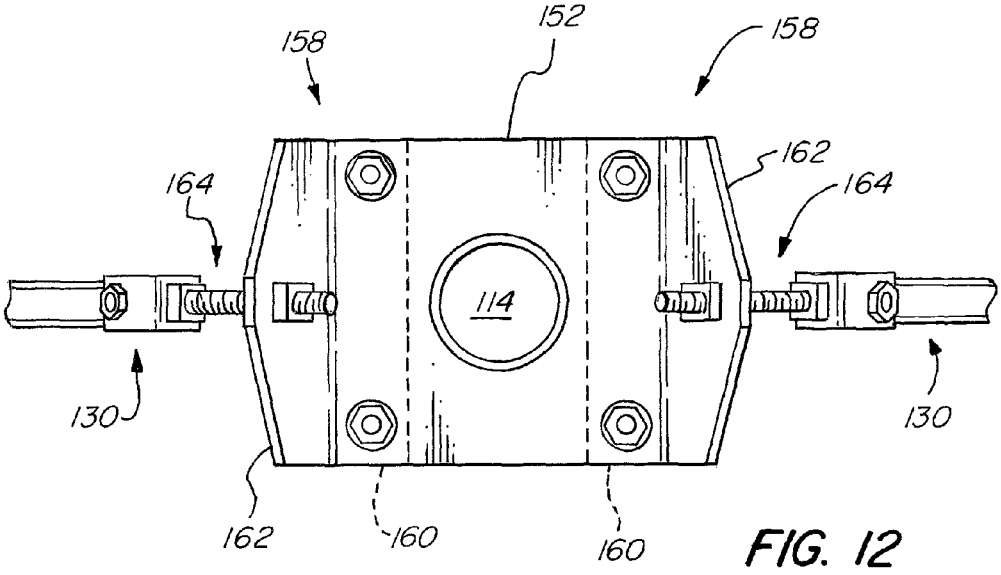
FIG. 12 is a plan view of two angled lateral support plates with two lateral supports attached.

FIG. 12 is a plan view illustrating the attachment of opposing angled lateral support plates 158 to the vertical pile top plate 150 positioned below the vertical post bottom plate 152. Each of the angled lateral support plates 158 is attached to a lateral support or helical support rod assembly 130. If necessary, additional lateral supports or helical support rod assemblies 130 may be attached to each of the four sides of the vertical pile top plate 150 under the vertical post bottom plate 152.

The operation and benefits of the present invention in this embodiment may be really appreciated with reference to FIGS. 7-12. A desired number of lateral supports or helical support rod assemblies 130 may be driven into the ground at an angle as needed depending upon the application. The helical pile 128 may be driven into the ground to a depth sufficient so that the lateral support or helical support rod assembly 130 is substantially adjacent the vertical pile top plate 150. The lateral movement permitted by the shackle 166 in combination with the longitudinal adjustment permitted by the turnbuckle 164 facilities alignment of the lateral support or helical support rod assembly 130 to the through hole 182 in the lateral support leg 162 of the angled lateral support plate 158. The turnbuckle 164 can be adjusted to provide a desired load on the helical pile 128 so as to assure that there is no lateral movement of the helical pile 128 and the connected vertical post 114.

The use of the combination of a helical pile 128 and the lateral support provided by the helical support rod assembly 130 that has a longitudinal axis that intersects or transverses the longitudinal axis of the helical pile 128 provides a foundation for a post 114 that is easily and quickly installed and yet provide substantially improved resistance to lateral loading.

Accordingly, the present invention provides a helical pile that has substantially improved lateral support so that large posts can be securely attached. The present invention particularly improves and provides a much quicker solution to supporting vertical fence support posts for supporting a safety support fence used in a ball field. This makes the erection of the safety support fence less expensive, easier, and quicker.

What is claimed is:

1. A post support structure for placement underground comprising:

a pile having a longitudinal length and a top plate at one end and a pilot point at the other end;

helical plates attached to said pile along the longitudinal length;

an angled lateral support plate attached to the top plate;

a turnbuckle attached to said angled lateral support plate;

a lateral support rod attached to said turnbuckle and positioned between the top plate and the pilot point of said pile and extending transverse to the longitudinal length of said pile; and a helical plate attached to said lateral support rod;

whereby a vertical support post is capable of being attached to the top plate of said pile and lateral loads supported.

2. A foundation support for a pole or post comprising:

a helical pile comprising a vertical pile having a pile longitudinal axis and a pile helix attached to said helical pile, said helical pile having a distal end with a pilot point and a proximal end;

a pile top plate attached to the proximal end of said helical pile, said pile top plate having a perimeter and a plurality of through holes spaced about the perimeter, said plurality of through holes each adapted to receive a fastener;

an angled lateral support plate attached to said pile top plate; and a helical support rod attached to said angled lateral support plate, said helical support rod having a rod longitudinal axis and a rod helix attached to said helical support rod, said helical support rod being attached to said angled lateral support plate so that the rod longitudinal axis transverses the pile longitudinal axis when extended, whereby a vertical post is capable of being attached to said vertical pile top plate.

3. A foundation support for a pole or post as in claim 2 further comprising:

a turnbuckle attached between said angled lateral support plate and said helical support rod.

4. A foundation support for a pole or post as in claim 3 further comprising:

a shackle attached between said turnbuckle and said helical support rod.

5. A foundation support for a pole or post as in claim 2 further comprising:

a plurality of helixes positioned along the longitudinal length of said helix pile.

6. A foundation support for a pole or post as in claim 2 wherein:

said angled lateral support plate has a plurality of through holes adapted to align with at least two of the plurality of through holes along a portion of the perimeter of said pile top plate.

7. A foundation support for a pole or post as in claim 2 wherein:

said angled lateral support plate comprises a pile leg and a lateral support leg having an angle there between ranging from between one hundred and twenty five and one hundred and forty-five degrees.

8. A foundation support for a pole or post as in claim 7 wherein:

the angle is substantially one hundred and thirty-five degrees.

9. A foundation support for a pole used for a suspended safety fence and foul pole on an athletic field comprising:

a helical pile comprising a vertical pile having a pile longitudinal axis and a pile helix attached to said helical pile, said helical pile having a distal end with a pilot point and a proximal end adapted to attach to the pole;

a vertical pile top plate attached to the proximal end of said helical pile, said vertical pile top plate having a plurality of through holes spaced about the perimeter, said plurality of through holes each adapted to receive a fastener;

an angled lateral support plate, said angled lateral support plate having a pile leg and a lateral support leg having a substantially one hundred and thirty-five degree angle there between, the pile leg attached to said vertical pile top plate;

a turnbuckle having one end attached to the pile leg of said angled lateral support plate;

a shackle attached to an opposing end of said turnbuckle; and a helical support rod attached to said shackle, said helical support rod having a rod longitudinal axis and a rod helix attached to said helical support rod, said helical support rod being attached to the lateral support leg of said angled lateral support plate by said turnbuckle and said shackle so that the rod longitudinal axis transverses the pile longitudinal axis, whereby a vertical post is capable of being attached to said vertical pile top plate providing lateral support for the suspended safety fence and foul pole on the athletic field.

10. A post support system for a suspended safety fence on an athletic field comprising:

a helical pile having a longitude axis, a helix extending radially from said helical pile, and a top plate attached to one end;

an angled lateral support plate attached to the top plate;

a turnbuckle attached to said angled lateral support plate;

a shackle attached to said turnbuckle;

a lateral support rod attached to said shackle and positioned between the top plate and an end of said helical pile and extending transverse to a longitudinal length of said helical pile, whereby said lateral support rod is placed underground when installed;

a helical plate attached said lateral support rod;

a fence support post attached to the top plate of said helical pile; and a suspended safety fence attached to said fence support post at a distance from said fence support post, whereby said lateral support rod and said helical plate are installed underground and compensates for lateral loads placed on said fence support post by said suspended safety fence suspended at a distance from said fence support post.

* * * * *